US007859414B2

(12) United States Patent
Kai et al.

(10) Patent No.: US 7,859,414 B2
(45) Date of Patent: Dec. 28, 2010

(54) TAG ANTENNA AND TAG

(75) Inventors: Manabu Kai, Kawasaki (JP); Toru Maniwa, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 331 days.

(21) Appl. No.: 12/128,439

(22) Filed: May 28, 2008

(65) Prior Publication Data

US 2009/0058658 A1 Mar. 5, 2009

(30) Foreign Application Priority Data

Aug. 30, 2007 (JP) ..... 2007-223813

(51) Int. Cl.
*G08B 13/14* (2006.01)

(52) U.S. Cl. ..... 340/572.7; 340/572.4

(58) Field of Classification Search ..... 340/572.7, 340/572.1, 572.8, 572.4, 582.5; 343/850, 343/857

See application file for complete search history.

(56) References Cited

U.S. PATENT DOCUMENTS 6,018,299 A * 1/2000 Eberhardt ..... 340/572.7
6,107,920 A * 8/2000 Eberhardt et al. ..... 340/572.7
7,416,135 B2 * 8/2008 Tanaka et al. ..... 235/492
7,453,360 B2 * 11/2008 Glaser ..... 340/572.1
2006/0109177 A1 5/2006 Prieto-Burgos et al.
2006/0244605 A1 11/2006 Sakama et al.

FOREIGN PATENT DOCUMENTS

| | | | |
|---|---|---|---|
| DE | 10 2004 045 707 | A1 | 3/2006 |
| EP | 1 895 620 | A1 | 5/2008 |
| JP | 2002-298106 | | 10/2002 |
| JP | 2006-140735 | | 6/2006 |
| JP | 2006-237674 | | 9/2006 |
| JP | 2006-311372 | | 11/2006 |
| WO | WO 2006/021914 | A1 | 3/2006 |
| WO | WO 2006/134658 | A1 | 12/2006 |

OTHER PUBLICATIONS

Communication forwarding Extended European Search Report dated Nov. 11, 2008 issued in corresponding European Application No. 08156841.2-2220.

* cited by examiner

*Primary Examiner*—Anh V La
(74) *Attorney, Agent, or Firm*—Fujitsu Patent Center

(57) ABSTRACT

A tag antenna is composed of a dielectric spacer, and an antenna pattern which is formed on one of surfaces of the spacer and has a size smaller than one half of a wavelength at an operating frequency, and in which a slit pattern suitable for the resistance and the capacitive components of a chip to be mounted is formed.

10 Claims, 15 Drawing Sheets

TAG ANTENNA AND TAG

BACKGROUND OF THE INVENTION

1. Field of the Invention

The present invention relates to a tag used in an RFID system, namely, a wireless IC tag, and more particularly, to a tag antenna used for such a wireless IC tag, and a tag mounting the tag antenna and an IC chip.

2. Description of the Related Art

RFID (Radio Frequency IDentification) systems are widely used for the management, etc. of objects, or the like. In these systems, a reader/writer emits a radio wave to a tag, the tag returns to the reader/writer information within the tag by a radio wave, and the reader/writer reads the information within the tag. The band of the radio wave is a UHF band. Frequencies in the vicinities of 868 MHz, 915 MHz, and 953 MHz are used in Europe, the United States, and Japan respectively. Depending on the performance of a chip mounted within the tag, a communication distance is approximately 3 to 5 m, and the output of the reader/writer is on the order of 1 W.

There is an advantage in using a dipole antenna as an antenna of such a wireless IC tag that a favorable directivity can be obtained. However, the efficiency of the antenna is maximized when the length of the antenna is one half of the wavelength λ of the radio wave. This leads to a problem that the length of the antenna increases, which in turn disables the downsizing of the tag. Additionally, if there is a metal in the neighborhood of such a dipole antenna being used, the communication distance of the tag significantly decreases.

For example, a patch antenna is conventionally used as an antenna used for a tag attached to a metal. FIG. 1 explains a conventional example of such a patch antenna. In this figure, the patch antenna is composed of a patch conductor 100, a ground conductor 101 on the back surface of a dielectric 102, and the dielectric 102 interposed between the patch conductor 100 and the ground conductor 101. An IC chip is mounted in a chip mounting part 103 on the side of the patch conductor 100. One of terminal electrodes of the IC chip is connected to a suitable portion of the patch conductor 100 positioned on the front surface, whereas the other of the terminal electrodes is connected to the back surface, namely, the ground conductor 101 via a through hole 104.

FIG. 2 shows an example of the communication distance of the patch antenna shown in FIG. 1. For example, if the size of the IC chip is implemented as a 1-mm-square, and the number of tags n is 1, 3 m is obtained as the communication distance at the frequency of 953 MHz. However, for example, if a plurality of identical tags are used in a close range, namely, if the number of tags n is 2 or 3, the characteristic curve of the communication distance shifts to the side of low frequencies, and the communication distance at the frequency of 953 MHz significantly decreases.

Patent Documents 1 to 4 disclose the conventional techniques related to such a wireless IC tag, and an antenna used for such a tag. Patent Document 1 discloses the non-contact IC tag that can hold the read/write state of data constant regardless of a substance positioned on the back surface of the tag by comprising an antenna and a reflection plate with a spacer interposed in between in a structure similar to that shown in FIG. 1.

Patent Document 2 discloses a planar antenna that can reduce an impedance by providing a notch in a folded structure, and can match the impedance to that of the feeding line of 50Ω without requiring an impedance converting circuit, etc.

Patent Document 3 discloses the technique for providing a patch antenna, which has ground and antenna surfaces sandwiching a dielectric in a similar manner, and in which a hole for causing the dielectric to protrude from the antenna surface is provided, and a region sectioned by the protruding dielectric from the hole on the antenna surface forms a matching circuit for a transmission/reception element.

Patent Document 4 discloses the technique for implementing a wireless IC tag with high directivity by using a microstrip antenna where a hook-shaped slit is formed in a mounting portion of a chip on an emission conductor located on the front surface of a dielectric.

However, for example, according to Patent Document 1, the distance between the antenna surface and the reflection plate is equal to or longer than 30 mm when the read distance is maximized, and the thickness of the spacer increases, leading to difficulties in downsizing the IC tag. Also the conventional example shown in FIG. 1 and the techniques disclosed by Patent Documents 2 to 4 cannot solve the problems that a cost is increased by making a through hole, and a communication distance decrease when a plurality of tags are used in a close range, and have difficulties in downsizing an antenna while holding a practical communication distance.

[Patent Document 1] Japanese Published Unexamined Application No. 2002-298106 "Non-contact IC Tag"

[Patent Document 2] Japanese Published Unexamined Application No. 2006-140735 "Planar Antenna"

[Patent Document 3] Japanese Published Unexamined Application No. 2006-237674 "Patch Antenna and RFID Inlet"

[Patent Document 4] Japanese Published Unexamined Application No. 2006-311372 "Wireless IC Tag"

SUMMARY OF THE INVENTION

An object of the present invention is to provide a low-cost tag antenna in which a tag attachable to a metal can be downsized while holding a practical communication distance with a reader/writer, and the communication distance can be prevented from being significantly decreased even when a plurality of tags are used in a close range.

The tag antenna according to the present invention is an antenna used for a tag that transmits/receives a radio wave to/from a reader/writer, and composed of a dielectric spacer, and an antenna pattern formed on one of surfaces of the spacer. The antenna pattern is smaller than λ/2 resonant length, which corresponds to an operating frequency, in size, and has a slit pattern sized suitably for the resistance component and the capacitive component of a chip to be mounted.

In the antenna pattern in preferred embodiments according to the present invention, a slit pattern and a cut part are formed, and an antenna emission resistance and an inductance, which correspond to the slit pattern and the cut part, are comprised, the inductance and the capacitive component of the chip satisfy a resonance condition at the operating frequency, and the antenna emission resistance and the resistance component of the chip become identical in magnitude.

The tag according to the present invention is a tag where a chip to be mounted is mounted on the above described antenna pattern.

As described above, in the tag according to the present invention, the size of the antenna pattern is smaller than λ/2 resonant length at the operating frequency, and at least a slit pattern for matching the resistance and the capacitive components of the chip to be mounted is comprised.

According to the present invention, the tag can be downsized by making the antenna pattern smaller than λ/2 resonant length, whereby the tag attachable to a metal while holding a communication distance can be provided. A through hole connecting between the antenna pattern and the metal reflection plate is no longer necessary, whereby the cost can be reduced. Additionally, the tag according to the present invention is smaller than λ/2 resonant length in size, and interference does not occur among tag antennas even when the tags are arranged in a close range. As a result, a communication distance can be prevented from being significantly decreased.

DESCRIPTION OF THE PREFERRED EMBODIMENTS

Figure 1:
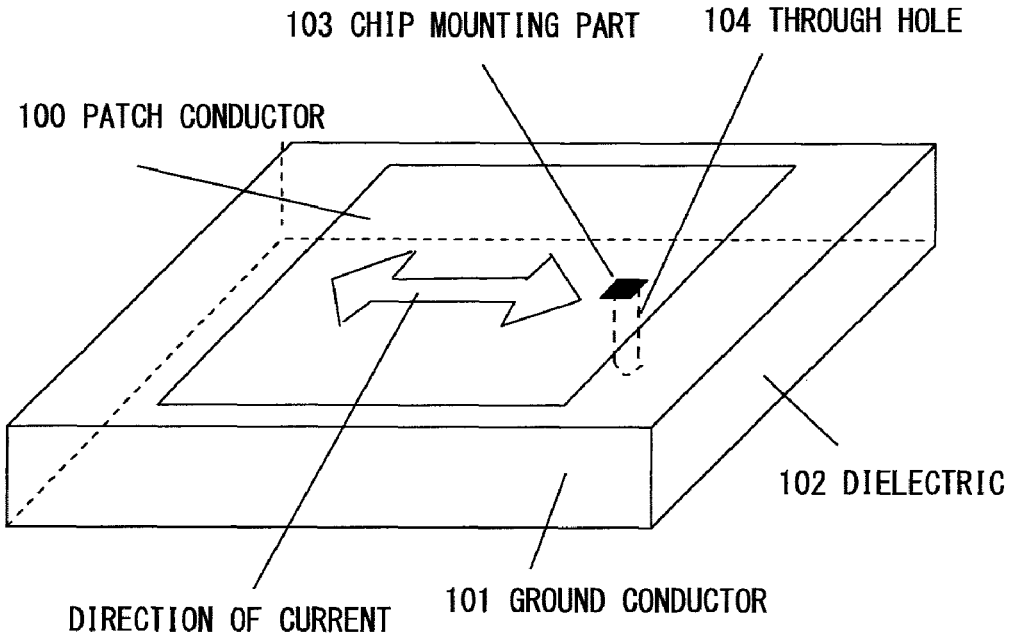
FIG. 1 explains a configuration of a conventional example of a tag antenna.
Figure 2:
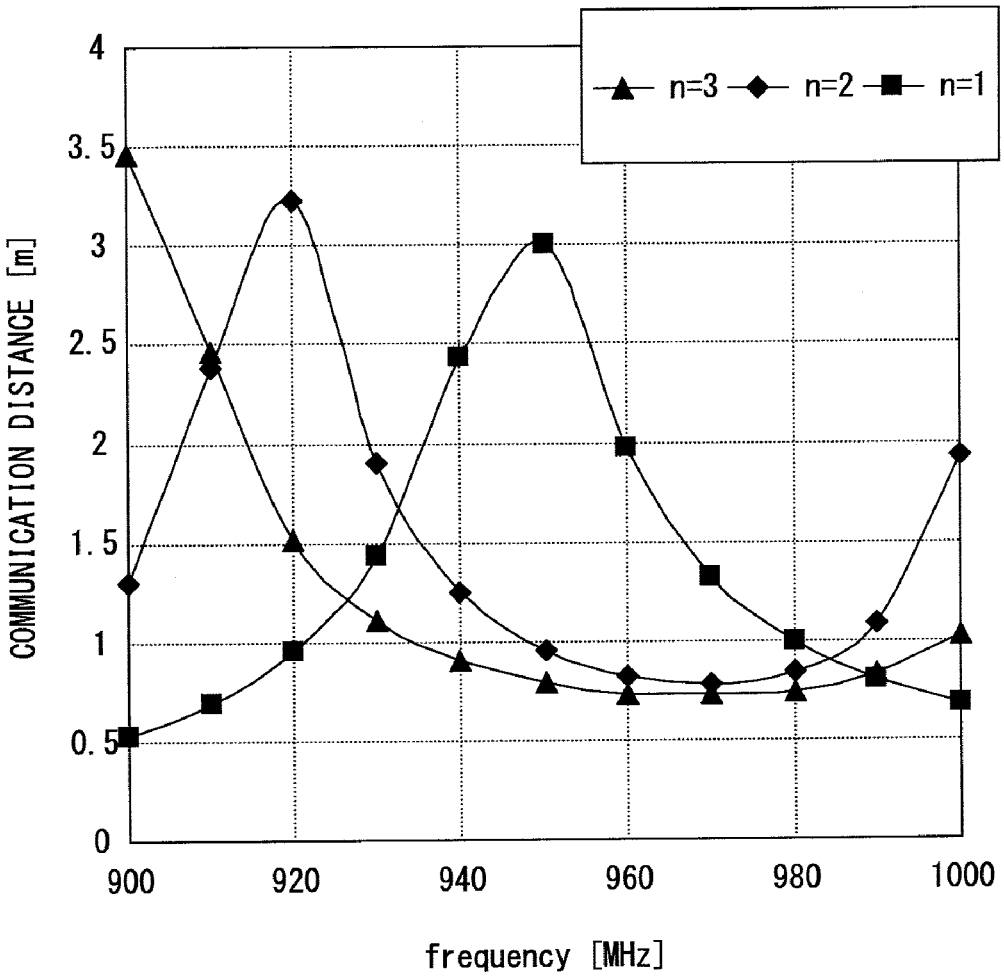
FIG. 2 explains a communication distance when tag antennas of the conventional example are arranged in a close range.
Figure 3:
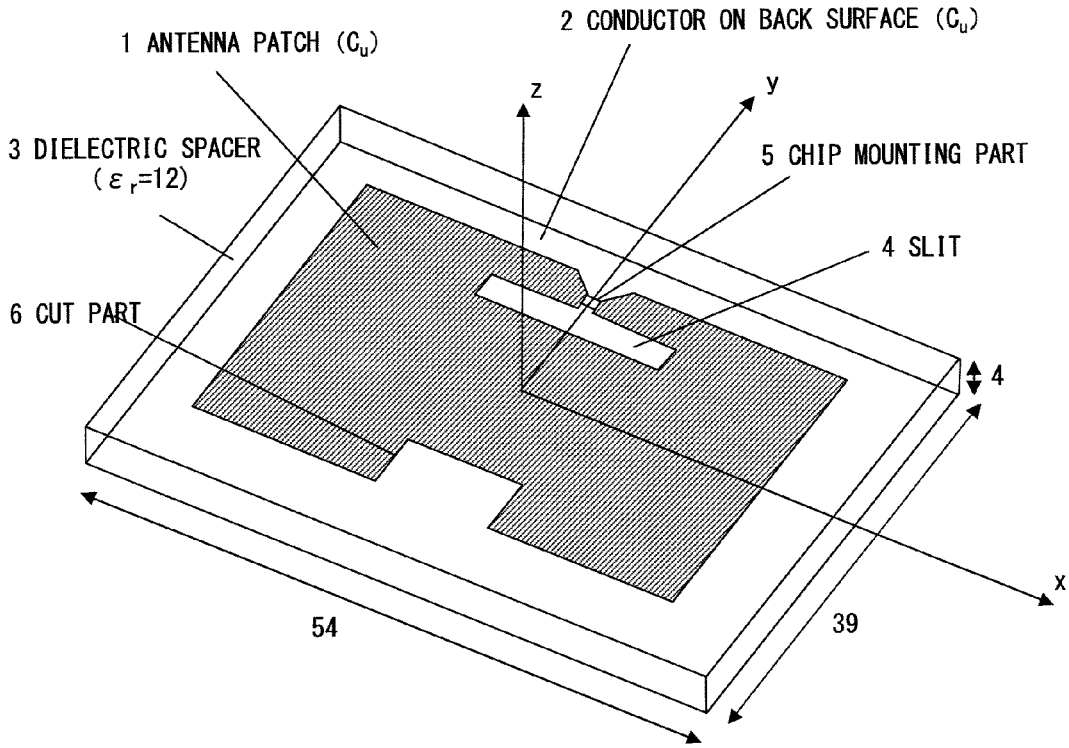
FIG. 3 shows a basic configuration of a tag antenna according to a first preferred embodiment.

FIG. 3 explains the basic configuration of a tag antenna according to the first preferred embodiment of the present invention. In this figure, the tag antenna is formed by interposing a dielectric spacer 3 between an antenna patch (Cu) 1 as a front surface conductor and a back surface conductor (Cu) 2. The value of the relative permittivity $\in_r$ of the dielectric spacer 3 is assumed to be equal to or larger than 10. Here, the value is assumed to be 12.

The dimensions of the entire tag mounting an IC chip on the side of the antenna patch 1 is assumed to be, for example, 54 mm (width) by 39 mm (depth) by 4 mm (height). Assume that the dimensions are determined basically by the size of the dielectric spacer 3, and the antenna patch 1 as the front surface conductor has an area smaller than the dielectric spacer 3. Also assume that the antenna patch 1 of the tag antenna according to the first preferred embodiment is manufactured by etching a copper plate on the front surface of the copper-clad dielectric spacer.

On the antenna patch 1 as the front surface conductor, a slit 4 is formed in the vicinity of 0 as a center on the x coordinate shown in FIG. 3, and a notch is provided between the slit 4 and a side of the antenna patch 1, which is parallel to the x axis. The notch is used as a chip mounting part 5. Namely, the IC chip is mounted by respectively connecting its two connection terminals to metal portions at both ends of the notch. As a result, the entire body operates as an RFID tag.

On the antenna patch 1, a cut part 6 is provided, for example, on a side opposite to the side on which the slit 4 is provided. The entire tag antenna shown in FIG. 3 is represented as an equivalent parallel circuit of resistance and inductance as will be described later. The above described slit 4 is principally used to adjust the inductance, whereas the cut part 6 is used to adjust the equivalent resistance.

This preferred embodiment assumes that the operating frequency of the tag is 953 MHz as described above. At this time, a wavelength λ in the air is approximately 315 mm, and the value of λ/2 results in approximately 157 mm. However, since radio waves are transmitted/received by a configuration where the antenna patch 1 is formed on or attached to the dielectric spacer 3, an actual wavelength becomes shorter than the wavelength λ.

Normally, the wavelength of a radio wave within a dielectric having a relative permittivity $\in_r$ is as follows in comparison with that in the air.

$$1/\sqrt{\in_r}$$

In the structure shown in FIG. 3, not only the dielectric spacer 3 but also the air exists in the periphery of the antenna patch 1. Therefore, the wavelength λ results in an intermediate value, and the value of λ/2 results in, for example, on the order of 70 to 80 mm.

This preferred embodiment is characterized in that the size of the tag antenna, for example, the width of the antenna patch 1 in a direction parallel to the slit 4 is made smaller than the value of λ/2 in FIG. 3. The width of the dielectric spacer 3 in this direction is 54 mm, and that of the antenna patch 1 in this direction is naturally smaller than 54 mm in consideration of a manufacturing margin, and therefore becomes shorter than λ/2. In this sense, the antenna patch 1 shown in FIG. 3 is referred to as a small patch. In the structure using the small patch, the emission efficiency of the antenna becomes slightly lower than that in the case of using the resonance of λ/2. However, this structure is preferable from the viewpoints of downsizing and cost reductions.

As described above, the read distance is maximized when the thickness of the spacer is equal to or larger than 30 mm as disclosed by Patent Document 1. In this preferred embodiment, however, suitable operations are not performed as the tag antenna if the thickness of the dielectric spacer is large. Therefore, the thickness must fall within a range from 1 to 10 mm.

Figure 4:
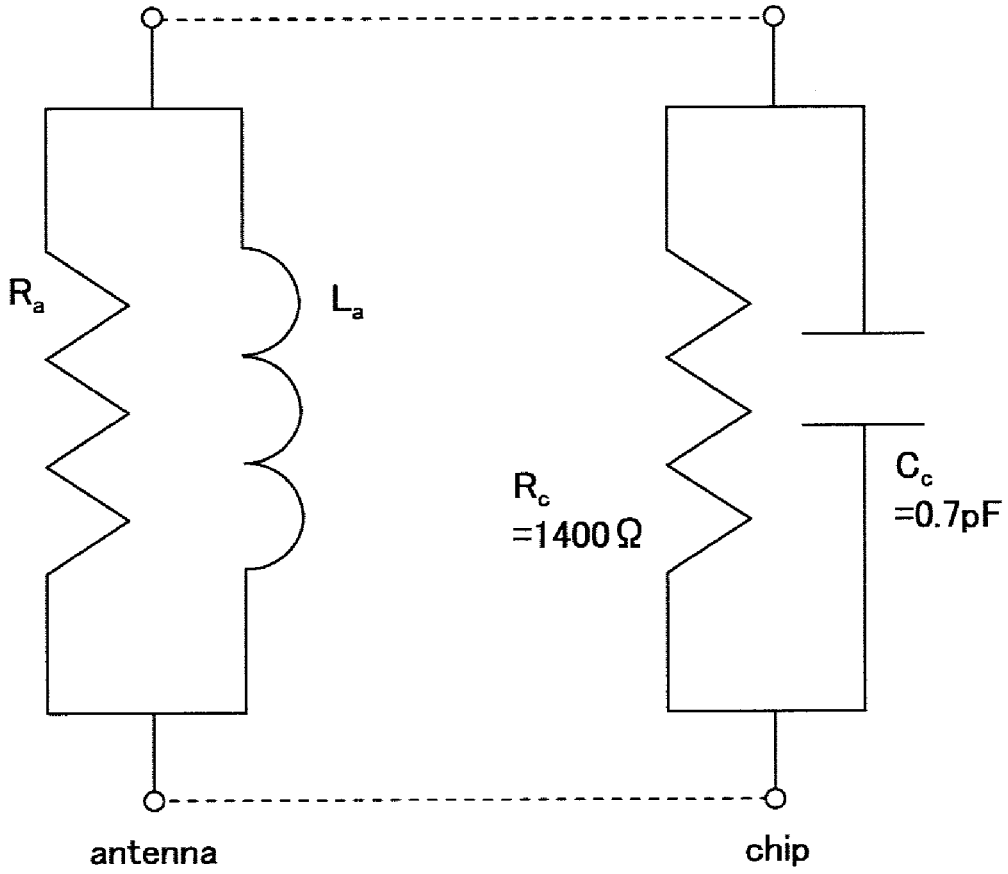
FIG. 4 explains a match between the impedances of the tag antenna and an IC chip.

FIG. 4 explains the impedances of the tag antenna and the IC chip, which are shown in FIG. 3. Here, assume that the IC chip mounted in the chip mounting part 5 shown in FIG. 3 is represented by an equivalent parallel circuit with a resistance $R_c$ of 1400Ω and a capacitance $C_c$ of 0.7 pF. To make a match between the chip and the tag antenna, a resonance condition must be satisfied between an inductance $L_a$ and the capacitance $C_c$ of the IC chip, and the values of an antenna emission resistance $R_a$ and the resistance $R_c$ of the IC chip must be equal when the equivalent circuit of the tag antenna is represented by a parallel circuit of the antenna emission resistance $R_a$ and the inductance $L_a$. When the resonance condition is satisfied, the following relational expression holds between the operating frequency $f_0$, the inductance $L_a$, and the capacitance $C_c$.

$$f_0 = 1/2\pi\sqrt{L_a C_a}$$

In FIG. 3, the equivalent inductance $L_a$ of the tag antenna is basically determined by the length of the metal portion that surrounds the slit 4 except for the length of the notch as the chip mounting part 5. Accordingly, not the width but the total length of the slit 4 basically determines the inductance $L_a$. Additionally, the entire periphery of the notch as the chip mounting part 5 determines the antenna emission resistance $R_a$. By providing the cut part 6 on the antenna patch 1, and by adjusting the size of the cut part 6, the antenna emission resistance $R_a$ is adjusted to almost the same value as that of the input resistance $R_c$ of the chip. The impedances can be also made to match without providing the cut part 6 depending on, for example, the size of the antenna patch 1 or the slit 4.

Figure 5:
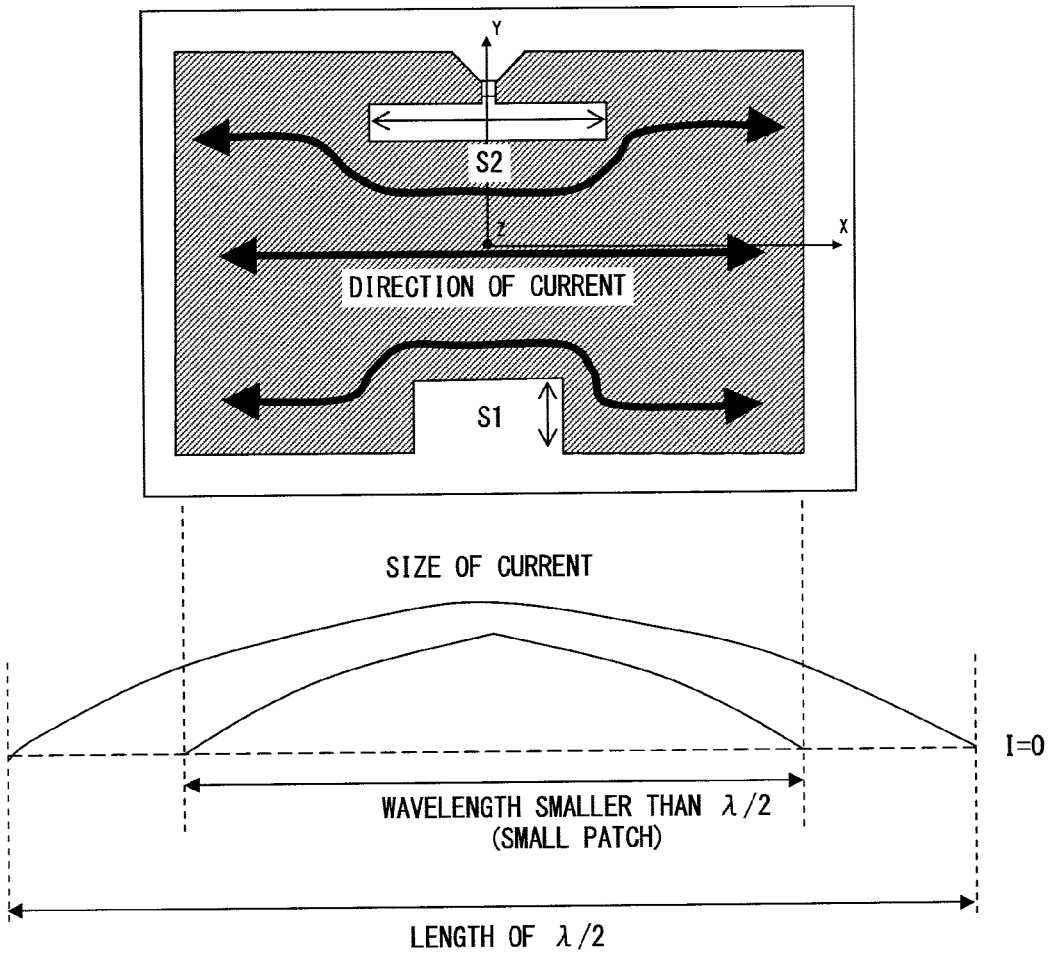
FIG. 5 explains a current distribution on an antenna patch.

FIG. 5 explains a current distribution of the tag antenna according to the first preferred embodiment. An electric current flows in the direction of the slit 4 described with reference to FIG. 3, namely, in the horizontal direction, and a sufficient radio wave is emitted. If the width of the antenna patch 1 in the horizontal direction is, for example, on the order of 70 to 80 mm corresponding to $\lambda/2$ as described above, a high current flows as the resonance of $\lambda/2$. In this preferred embodiment, however, the width is equal to or smaller than 54 mm and shorter than $\lambda/2$. Therefore, the size of the current slightly becomes low. However, a relatively high current flows in the vicinity of the center of the tag. The size of the current on the side at both horizontal ends of the antenna patch 1 becomes 0.

Assume that the length $S_2$ of the slit 4, and the depth $S_1$ of the cut part 6 in the depth direction are adjusted in the current distribution of the antenna patch 1 shown in FIG. 5 so that the inductance $L_a$ and the capacitance CC of the chip satisfy the resonance condition at the operating frequency, and the antenna emission resistance $R_a$ and the resistance $R_c$ of the chip become equal as described with reference to FIG. 4. As described above, the value of the antenna emission resistance $R_a$ is basically determined by the depth $S_1$ of the cut part 6, and the value of the inductance $L_a$ is basically determined by the value of the length $S_2$ of the slit 4. For example, the width of the cut part 6 in the horizontal direction is uniform here. By varying this width, the value of the antenna emission resistance $R_a$ can be also adjusted.

Figure 6:
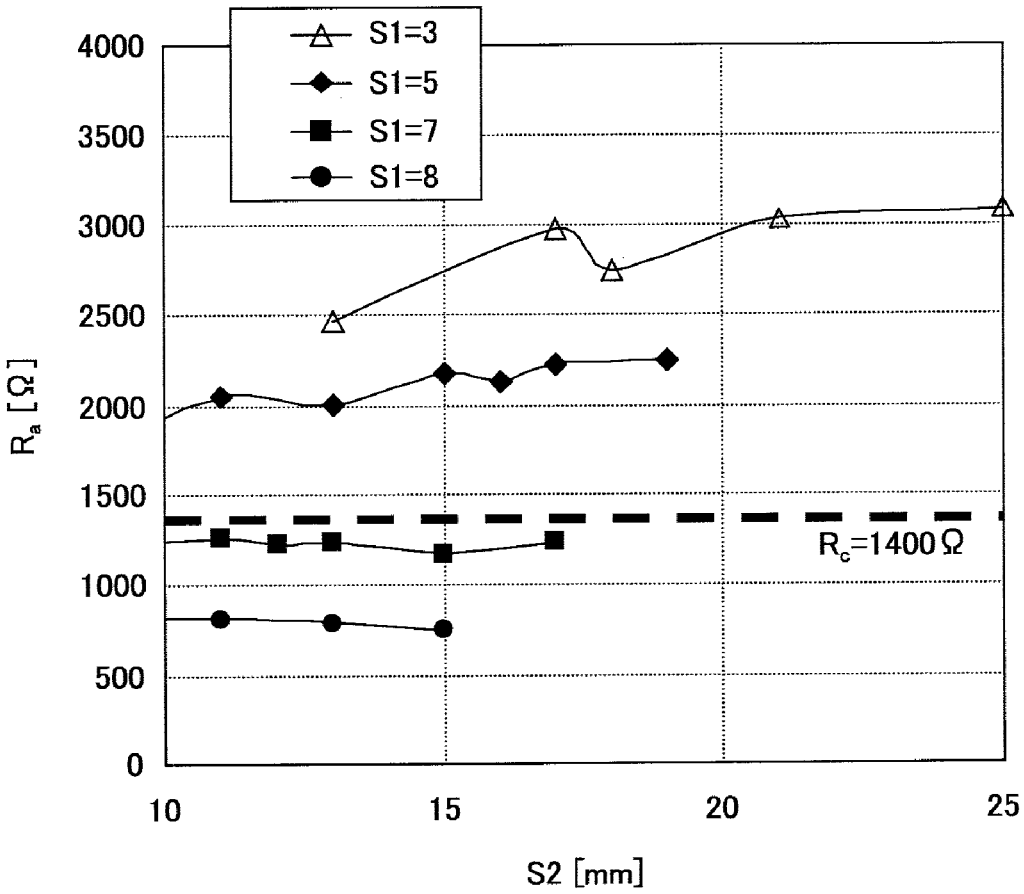
FIG. 6 shows calculation results of an antenna emission resistance shown in FIG. 4.
Figure 7:
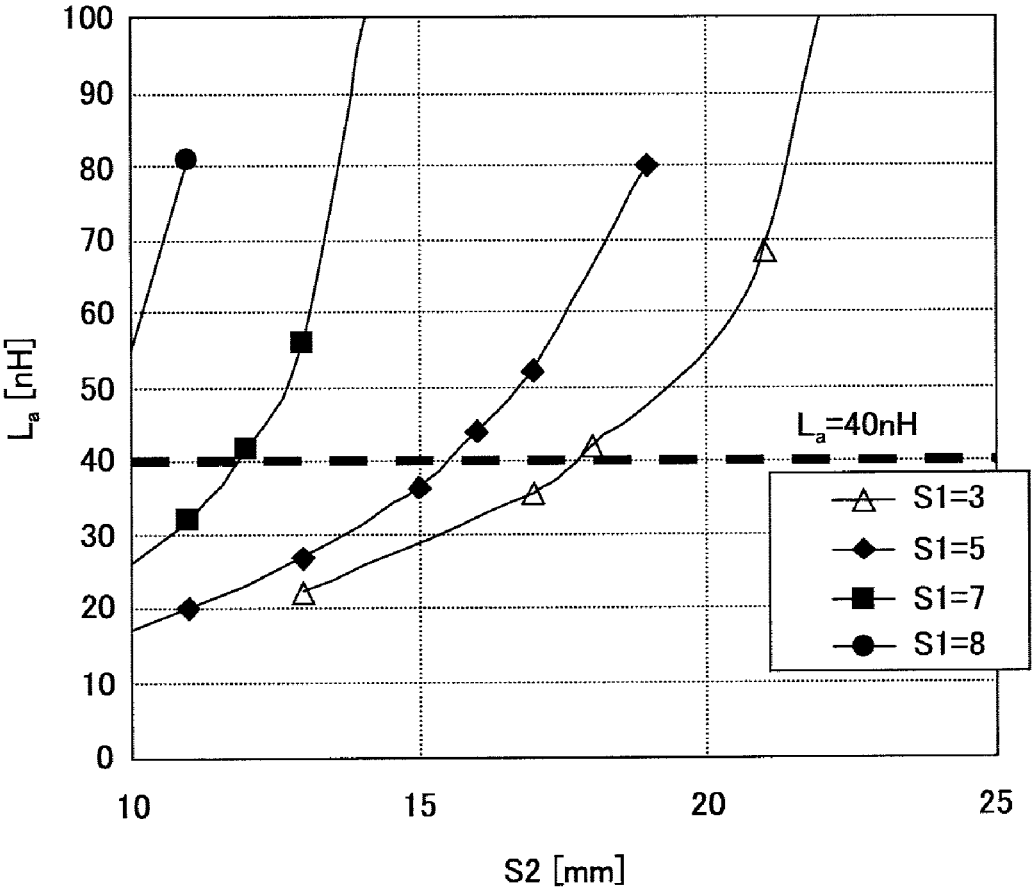
FIG. 7 shows calculation results of the inductance shown in FIG. 4.

FIGS. 6 and 7 show calculation results of the antenna emission resistance $R_a$ and the inductance $L_a$, which vary by adjusting the depth $S_1$ of the cut part 6 and the length $S_2$ of the slit 4. FIG. 6 shows the calculation results of the antenna emission resistance $R_a$ with respect to the total length $S_2$ of the slit when the value of the depth $S_1$ of the cut part 6 is used as a parameter. It is proved from this figure that the value of the antenna emission resistance $R_a$ can be made equal to that of the resistance $R_c$ of the chip almost regardless of the value of the total length $S_2$ of the slit 4 by setting the value of the depth $S_1$ of the cut part 6 to 7 mm.

FIG. 7 shows the calculation results of the inductance $L_a$ with respect to the total length $S_2$ of the slit 4 when the value of the depth $S_1$ of the cut part 6 is used as a parameter. It is proved from this figure that 40 nH is obtained as the value of the inductance $L_a$ that satisfies the resonance condition at the operating frequency along with the capacitance $C_c$ of 0.7 pF of the chip by setting the value of the length $S_2$ of the slit 4 to 12 mm when the value of the depth $S_1$ is set to 7 mm as described with reference to FIG. 6. FIGS. 6 and 7 merely show the calculation results. Actually, a practically sufficient characteristic as the tag antenna can be obtained by slightly adjusting the actual depth of the cut part 6 and the actual length of the slit 4 in the vicinities of the above obtained values, namely, the depth $S_1$ of 7 mm and the total length $S_2$ of 12 mm.

Figure 8:
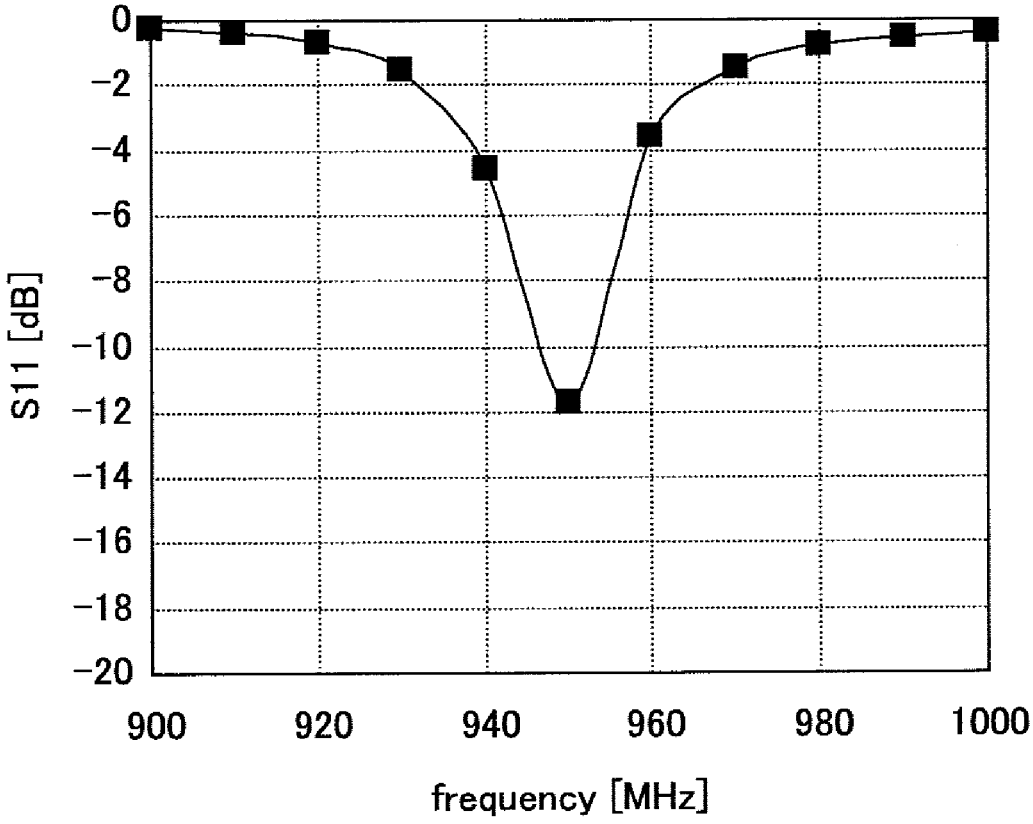
FIG. 8 shows calculation results of a reflection coefficient of the tag antenna to the IC chip.

FIG. 8 shows a reflection coefficient S11 of the antenna to the chip, which corresponds to the sizes of $S_1$ and $S_2$ determined in this way. The value of the reflection coefficient at the operating frequency of 953 MHz is on the order of −11.7 dB. This proves that a sufficient match is obtained.

Figure 9:
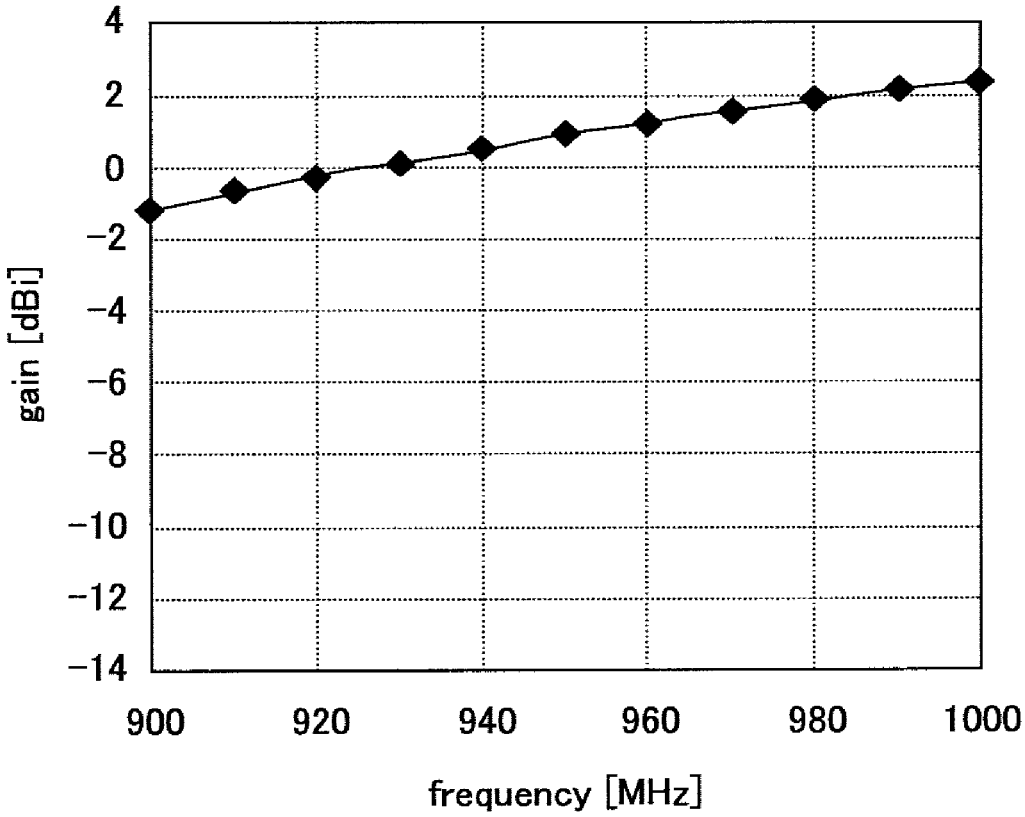
FIG. 9 shows calculation results of the gain of the tag antenna.

FIG. 9 shows the frequency characteristic of the gain of the tag antenna according to the first preferred embodiment. The gain on the order of 1 dBi is obtained at the operating frequency of 953 MHz. Here, dBi is the unit of the gain, for example, when an electric field distribution becomes completely spherical at the time of emitting a radio wave at a point.

Figure 10:
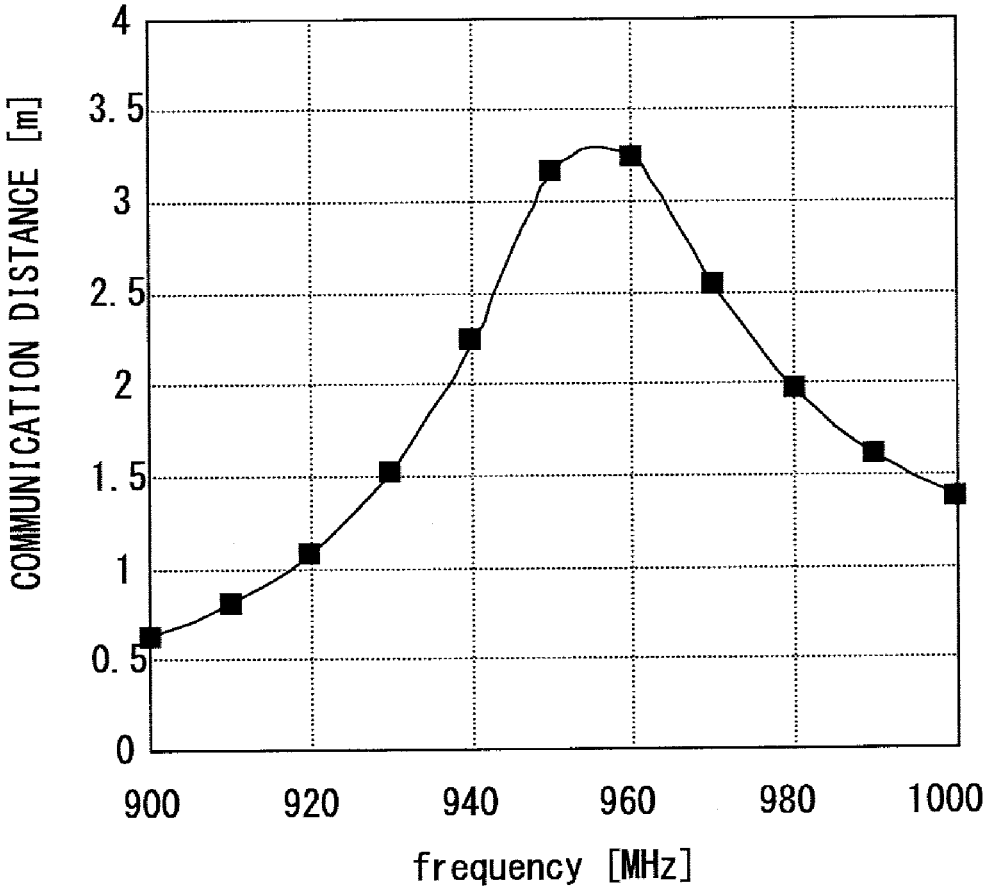
FIG. 10 shows calculation results of the communication distance of the tag antenna.

FIG. 10 shows calculation results of the communication distance based on FIGS. 8 and 9. These calculation results are obtained based on the assumption that the operating power of the chip, the output of the reader/writer, and the antenna gain on the side of the reader/writer are −9 dBm, 1 W, and 6 dBi respectively, and the value of approximately 3 m is obtained as the communication distance at the operating frequency of 953 MHz. Here, dBm is a value that expresses power$\times 10^3$ in decibels.

Figure 11:
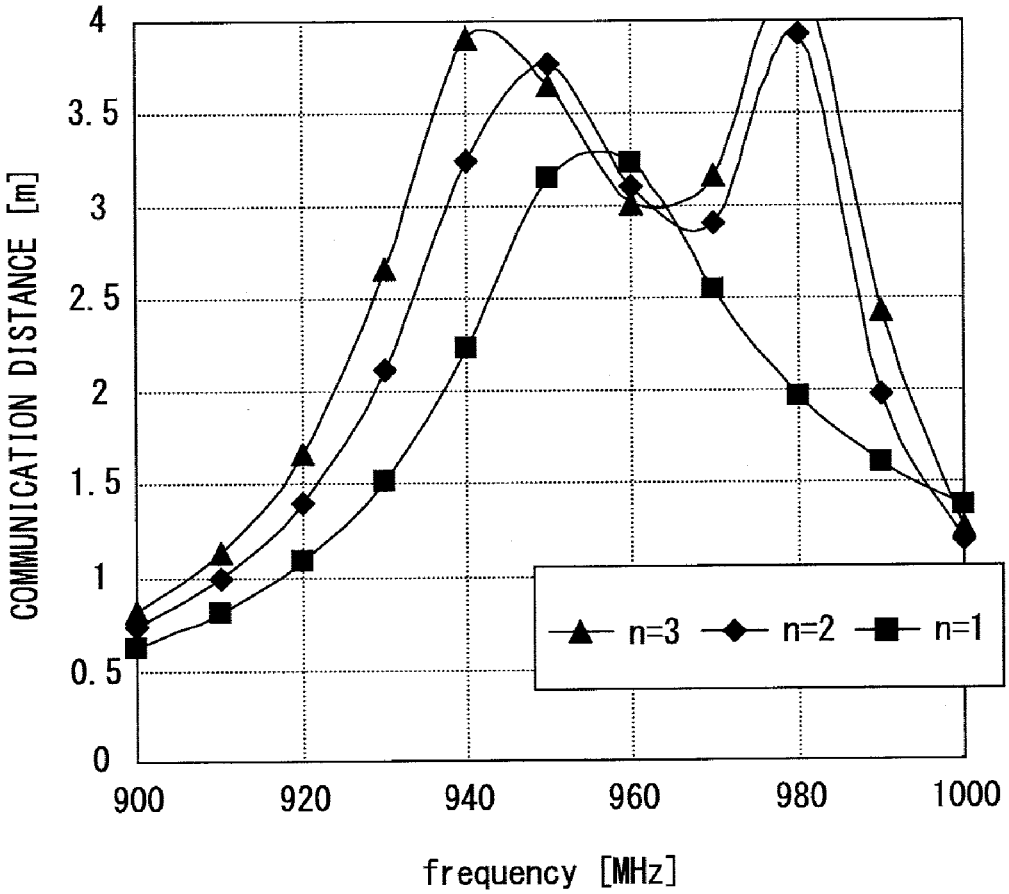
FIG. 11 shows calculation results of the communication distance when the tags are arranged in a close range.
Figure 12:
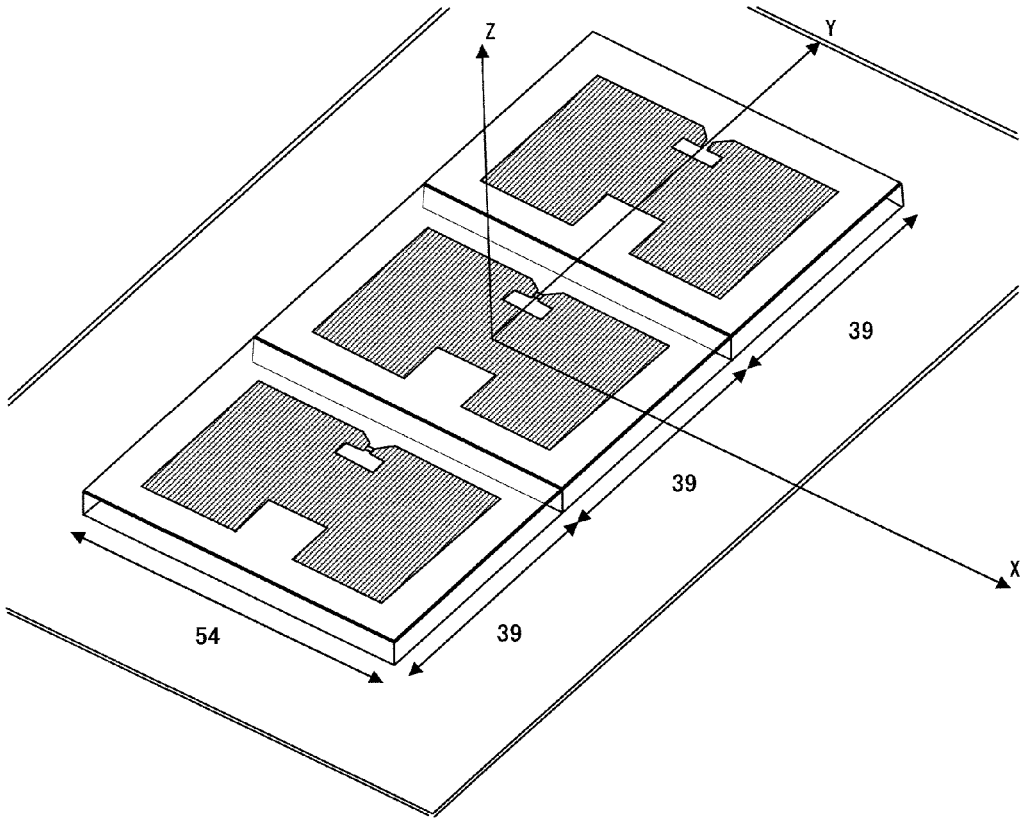
FIG. 12 explains a state which corresponds to FIG. 11 and in which the tags are arranged in a close range.

FIGS. 11 and 12 explain the communication distance when a plurality of tag antennas according to the first preferred embodiment are arranged. FIG. 11 shows calculation results of the communication distance when the tag antennas are arranged as shown in FIG. 12.

Normally, there is a possibility that tags exist in a considerably close range depending on the arrangement of objects even if each of the tags is attached to each of the objects. FIG. 12 shows such a state in the extreme. If tags are arranged in a close range when the length of the antenna patch is equal to $\lambda/2$, interference occurs among the radio waves of adjacent tags, and their communication distances significantly decrease. In an RFID system, the tags are used in a close range with high probability. From a practical viewpoint, it is vital to prevent the communication distances from being decreased even in such a case.

In FIG. 11, the communication distances at the operating frequency of 953 MHz are equal to or longer than 3 m when only one tag is used, namely, n is 1, and when n is 2 or 3. It is proved from this figure that the communication distances of the tags do not decrease also in the extreme arrangement shown in FIG. 12. This is owing to the effect that the size of the antenna patch 1, namely, the length in the horizontal direction is shorter than $\lambda/2$ in the first preferred embodiment.

Second and third preferred embodiments are described below with reference to FIGS. 13 to 15. The basic configurations of the tag antennas including the antenna patch in the second and the third preferred embodiments are similar to that in the first preferred embodiment. However, their manufacturing steps are different from that of the first preferred embodiment.

Figure 13:
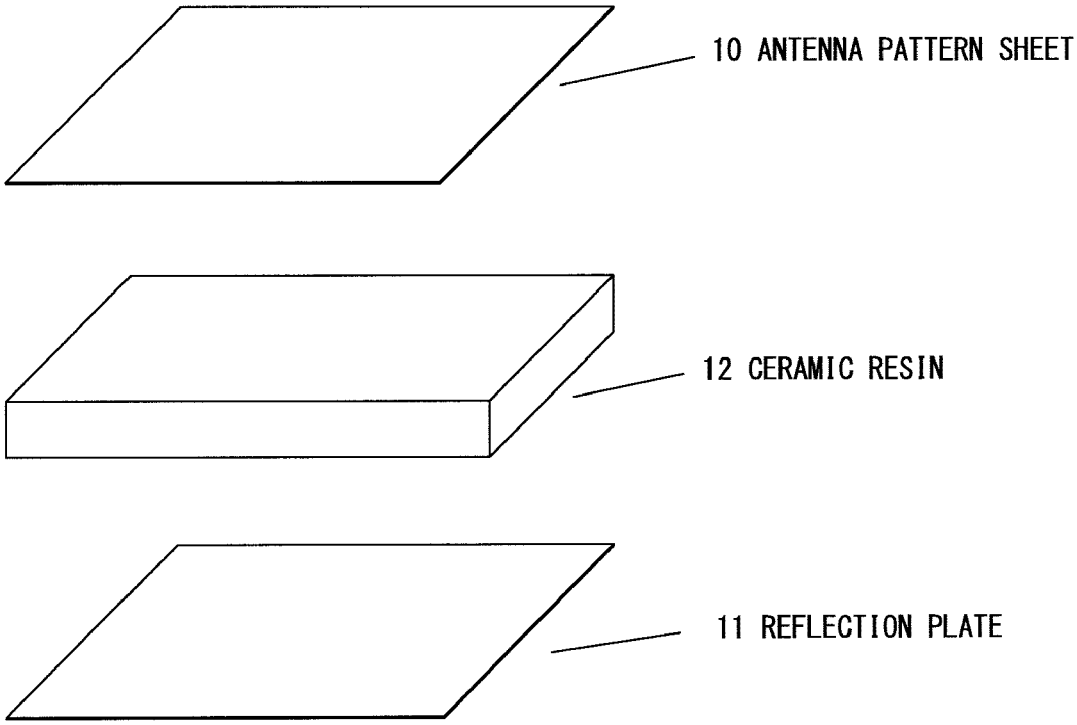
FIG. 13 explains the manufacturing step of a tag antenna according to a second preferred embodiment.

FIG. 13 explains the manufacturing step of the tag antenna according to the second preferred embodiment. The first preferred embodiment assumes that the antenna patch is manufactured by etching a metal portion of a copper-clad plate, which is affixed to the surface of the dielectric spacer 3 in advance, in the manufacturing step of the antenna patch 1 shown in FIG. 3. In the second preferred embodiment shown in FIG. 13, the tag antenna is manufactured by making an antenna pattern sheet, for example, as a rolled metal sheet beforehand, and by affixing the antenna pattern sheet 10 and a reflection plate 11 respectively to the upper surface of ceramic resin 12 as the dielectric spacer and its lower surface.

As a result, the cost of the tag antenna can be reduced compared with the configuration implemented by etching the copper-clad plate in the first preferred embodiment.

Figure 14:
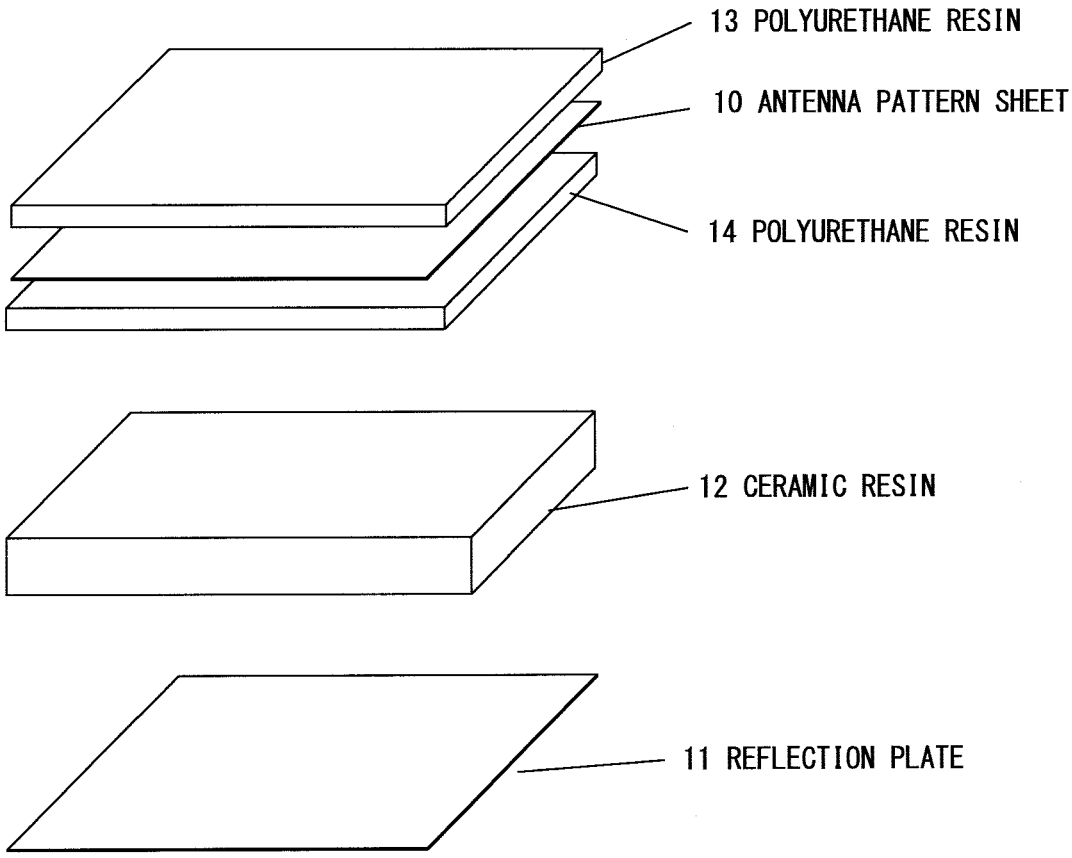
FIG. 14 explains the manufacturing step of a tag antenna according to a third preferred embodiment.

FIG. 14 explains the manufacturing step of the tag antenna according to the third preferred embodiment. Compared with the second preferred embodiment shown in FIG. 13, the configuration of the tag antenna shown in FIG. 14 is different in a point that polyurethane resins 13 and 14 are further affixed to the upper and the lower surfaces of the antenna pattern sheet 10. The polyurethane resins 13 and 14 are intended to improve the environmental resistance of the antenna patch including the IC chip. By affixing the polyurethane resins 13 and 14, the tag that does not fail to operate even in a corrosive environment or at a high temperature can be provided.

Figure 15:
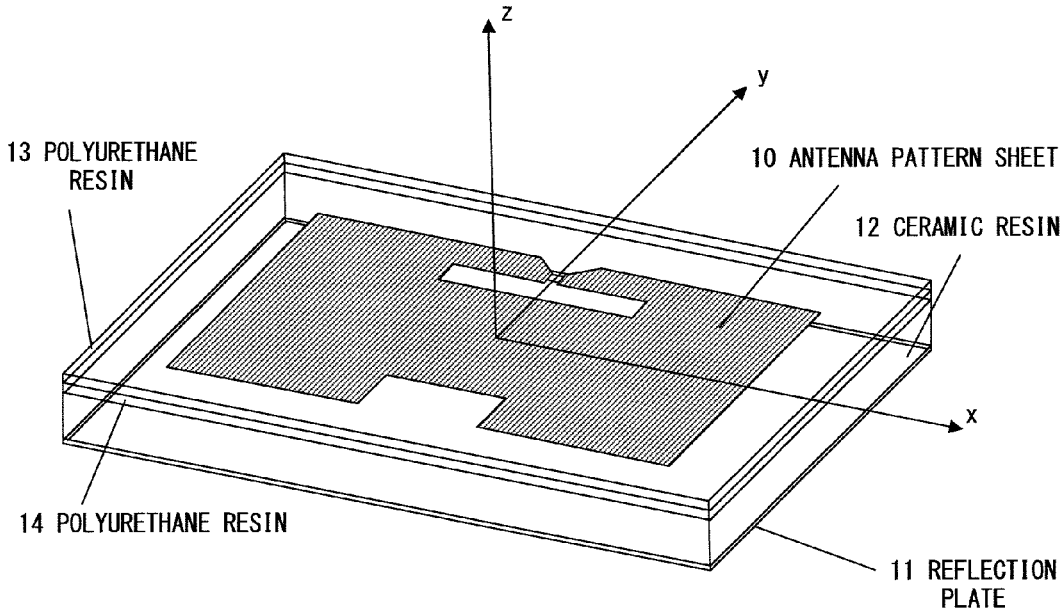
FIG. 15 shows the configuration of the tag antenna as a product according to the third preferred embodiment.

FIG. 15 shows the configuration of the tag as a product according to the third preferred embodiment described with reference to FIG. 14. In this figure, the antenna pattern sheet 10, namely, the antenna patch is sandwiched by the polyurethane resins 13 and 14 and affixed to the upper surface of ceramic resin 12, and the reflection plate 11 is affixed to the lower surface of the ceramic resin 12.

Up to this point, the characteristics of the tag antenna and the tag in this preferred embodiment have been described in detail. When the tag is affixed to a metal, the conductor, namely, the reflection plate positioned on the back surface (lower surface) of the dielectric spacer is no longer necessary.

Additionally, the chip mounting part described with reference to FIG. 3 is assumed to be arranged in the vicinity of the x coordinate of 0, namely, in the vicinity of the center of the antenna patch. However, the protrusion of the chip can sometimes be a hindrance, for example, to the printing of a barcode or characters on the upper surface of the tag. Therefore, the chip mounting part, and the slit for forming the inductance can be displaced toward the end of the antenna patch.

As described above in detail, the embodiments of present invention can provide the very small tag the dimensions of which are 54 mm by 39 mm by 4 mm, and which can implement the communication distance of approximately 3 m even when it is affixed to a metal. This tag does not require a through hole for connecting the upper and the lower surfaces. Additionally, the only thing to do is to adjust the length of the slit and the depth of the cut part in order for an impedance match, leading to reductions in man-hours required for the adjustment and cost. Furthermore, a communication distance equivalent to that in the case of using one tag can be obtained even when a plurality of tags are arranged in a close range. This greatly contributes to building a practical RFID system with high performance.

What is claimed is:

1. A tag antenna for a tag that transmits/receives a radio wave to a reader/writer, comprising:

a dielectric spacer; and a patch antenna which is formed on one of surfaces of said dielectric spacer, wherein a slit pattern to adjust an inductance is formed in said patch antenna and a width of said patch antenna in a direction parallel to said slit pattern is shorter than one half of a wavelength in consideration of wavelength shortening caused by said dielectric spacer.

2. The tag antenna according to claim 1, wherein:

said patch antenna has an antenna emission resistance and an inductance;

the inductance and a capacitive component of a chip to be mounted satisfy a resonance condition at an operating frequency; and the antenna emission resistance and a resistance component of the chip are equal in magnitude.

3. The tag antenna according to claim 1, wherein a cut part for adjusting an antenna emission resistance is formed in said patch antenna.

4. The tag antenna according to claim 1, wherein said patch antenna is covered with an environmentally resistant protection member.

5. The tag antenna according to claim 1, wherein a metal reflection plate is formed on the other of the surfaces of said dielectric spacer.

6. The tag antenna according to claim 1, wherein said dielectric spacer is made of ceramic resin.

7. The tag antenna according to claim 1, wherein a thickness of said dielectric spacer ranges from 1 to 10 mm.

8. The tag antenna according to claim 1, wherein said patch antenna is formed by etching a metal plate affixed to a front surface of said dielectric spacer.

9. The tag antenna according to claim 1, wherein a notch is provided between the slit pattern and a side of said patch antenna, and two terminals of the chip to be mounted are connected to metal portions of said patch antenna at both ends of the notch.

10. A tag that transmits/receives a radio wave to a reader/writer, comprising:

a chip;

a dielectric spacer; and a patch antenna which is formed on one of surfaces of said dielectric spacer, wherein a slit pattern to adjust an inductance is formed in said patch antenna and a width of said patch antenna in a direction parallel to said slit pattern is shorter than one half of a wavelength in consideration of wavelength shortening caused by said dielectric spacer.

* * * * *